US007182076B1

(12) United States Patent
Minker

(10) Patent No.: US 7,182,076 B1
(45) Date of Patent: Feb. 27, 2007

(54) SPARK-BASED IGNITING SYSTEM FOR INTERNAL COMBUSTION ENGINES

(76) Inventor: Gary A. Minker, 7225 Catalina Isle Dr., Lake Worth, FL (US) 33467

( * ) Notice: Subject to any disclaimer, the term of this patent is extended or adjusted under 35 U.S.C. 154(b) by 0 days.

(21) Appl. No.: 11/311,761

(22) Filed: Dec. 20, 2005

(51) Int. Cl.
*F02P 15/04* (2006.01)

(52) U.S. Cl. ..... 123/606; 123/143 B; 123/162

(58) Field of Classification Search ..... 123/143 B, 123/162, 606
See application file for complete search history.

(56) References Cited

U.S. PATENT DOCUMENTS 2,617,841 A * 11/1952 Linder ..... 123/143 B
3,934,566 A * 1/1976 Ward ..... 123/143 B
4,138,980 A * 2/1979 Ward ..... 123/143 B
4,297,983 A * 11/1981 Ward ..... 123/536
4,446,826 A * 5/1984 Kimura et al. ..... 123/143 B
4,561,406 A * 12/1985 Ward ..... 123/143 B
4,774,914 A * 10/1988 Ward ..... 123/162
5,983,871 A * 11/1999 Gordon et al. ..... 123/143 B
6,883,507 B2 * 4/2005 Freen ..... 123/143 B

* cited by examiner

*Primary Examiner*—T. M. Argenbright
(74) *Attorney, Agent, or Firm*—Davis Chin

(57) ABSTRACT

A spark-based igniting system for internal combustion engines includes a cylinder, at least one piston, a combustion chamber, a spark insert, and a RF energy source. The piston is disposed within the cylinder for moving slidably between a top dead center position and a bottom dead center position. The combustion chamber is formed in fluid communication with the piston. The spark insert is disposed in a top surface combustion face of the piston. The RF energy source is formed on the cylinder and adjacent to the combustion chamber for generating spark ignition energies to the spark insert to cause igniting of air/fuel mixture within the combustion chamber when the piston reaches near the top dead center position.

17 Claims, 5 Drawing Sheets

SPARK-BASED IGNITING SYSTEM FOR INTERNAL COMBUSTION ENGINES

BACKGROUND OF THE INVENTION

1. Field of the Invention

This invention relates generally to spark-ignition internal combustion type engines and more particularly, the present invention relates to an improved spark-based igniting system for internal combustion engines which eliminates the need of the conventional spark plug and the discharge of a high voltage into the combustion chamber.

2. Description of the Prior Art

As is generally well-known, spark-ignition internal combustion type engines are powered by gasoline or other petroleum-derived liquid or gaseous fuels. These combustion type engines usually utilize conventional spark plugs which are installed into the combustion chamber of the engine. The spark plugs are typically comprised of a terminal stud, insulator, shell and electrodes. The function of the spark plug is to introduce the ignition energy into the combustion chamber and to initiate the combustion of the air/fuel mixture via the electric spark produced between the energized electrode of the spark plug located within the combustion chamber and a grounded companion electrode. Thusly, a pair of electrodes or a plurality of electrodes usually exists in some specialty cases such as marine and aviation spark plugs.

However, these conventional spark-ignition engines suffer from the major disadvantage of requiring spark plugs which are relatively expensive to manufacture and frequently become defective so as to need replacement. Further, combustion in the spark-ignition engine is inefficient due to the fact that the ignition spark is applied more-or-less on a "single point" of the spark plug device and is accompanied by the production of unwanted atmospheric pollutants from the incomplete and inefficient combustion of the fuel mixture.

In view of these problems, there have been laws passed that govern strict exhaust emission standards in order to provide a cleaner and safer environment. In addition, the petroleum-derived fuel prices have been escalating in recent years and these future supplies are unknown and no alternate fuel source will be readily available in the immediate future for replacing such petroleum-derived fuel supplies.

Therefore, it should come as no surprise that modern spark ignition engines are have been developed and constructed heretofore in the prior art so as to produce more efficient petroleum-derived fueled combustion engines which maximize fuel economy and simultaneously minimize the generation of polluting exhaust emissions. In spite of these efforts in the prior art, it would be still desirable to provide an improved spark-based igniting system for internal combustion engines which does not require the use of conventional spark plugs. Further, it would also be expedient that the spark-based igniting system be made relatively simple in its design, construction, and operation; relatively low in cost; and substantially free from the production of atmospheric pollutants. This improved spark-based igniting system should also enhance the efficiency of the combustion engine.

A prior art search directed to the subject matter of this application in the U.S. Patent and Trademark Office revealed the following Letters Patent and application:

| | |
|---|---|
| 1,401,231 | 4,525,140 |
| 2,298,219 | 5,046,466 |
| 2,775,234 | 5,816,211 |
| 2,904,610 | 6,357,426 |
| 2,948,824 | 6,453,862 |
| 4,330,732 | 6,634,331 |

In U.S. Pat. No. 4,525,140 to Larigaldie et al. issued on Jun. 25, 1985, there is disclosed an ignition method and igniter device for igniting carbureted gaseous mixtures which includes a high voltage pulse that is applied through a dielectric between opposite surfaces thereof. The voltage is applied between a first electrode having a smaller area abutting against a first surface of the dielectric and a second electrode having a first strip portion abutting against an opposite second surface of the dielectric and a second portion which is astride an edge of the dielectric. The strip portion ends at a position beneath the first electrode. The first surface is exposed to the carbureted gaseous mixture.

In U.S. Pat. No. 6,357,426 to Schleupen issued on Mar. 19, 2002, there is taught an ignition device for a high-frequency ignition which includes a radio frequency resonator which is designed as a strip waveguide on a printed circuit board. Several resonators are connected in a pattern to the RF source via p-i-n diodes. At the cold end, the resonator is electrically isolated but is connected to ground via a capacitor. Ion currents are coupled in subsequent to the application of an auxiliary voltage.

In U.S. Pat. No. 6,453,862 to Holzmann issued on Sep. 24, 2002, there is taught an ignition device for piston-type internal combustion engines which includes a moving piston electrode disposed in the piston face and a counter-electrode arranged in the cylinder head. A spark gap is formed between the two electrodes wherein the spatial arrangement of the two electrodes is such the spark gap is smaller than the minimum distance between the counter-electrode and the piston face.

U.S. Pat. No. 6,634,331 issued on Oct. 21, 2003 to Truglio discloses a piston for use in an internal combustion engine which includes an insulating guide formed therein for receiving an electrode. The electrode has a body and at least one spark lead coupled to the body for inserting into a channel formed in the insulating electrode. Electrical power is supplied to the electrode by a power plug inserted through a power plug opening in the wall of the combustion chamber of the internal combustion engine. When electric power is supplied to the power plug, a first electrical arc is generated between the power plug and the body of the electrode and a second electrical arc is generated between the tip of each one of the spark leads and an associated arc insert disposed in the piston adjacent the end of the insulating guide.

The remaining patents, listed above but not specifically discussed, are deemed to be only of general interest and show the state of the art in internal combustion engines of the type which utilizes a spark igniting method for an air/fuel mixture within the combustion chamber of the combustion engine.

None of the prior art discussed above disclosed a spark-based igniting system like that of the present invention which includes a spark insert embedded in a top surface combustion face of a piston and a RF energy source for inducing spark ignition to the spark insert.

SUMMARY OF THE INVENTION

Accordingly, it is a general object of the present invention to provide an improved spark-based igniting system for internal combustion engines which is relatively simple and inexpensive in design, construction and operation.

It is an object of the present invention to provide a spark-based igniting system for internal combustion engines which is substantially free from the production of atmospheric pollutants.

It is another object of the present invention to provide a spark-based igniting system for internal combustion engines which has an enhanced efficiency of operation.

It is still another object of the present invention to provide a spark-based igniting system for internal combustion engines which includes a spark insert embedded in a top surface combustion face of a piston and a RF energy source for inducing spark ignition energies to the spark insert.

It is still yet another object of the present invention to provide a spark-based igniting system for internal combustion engines which includes a hemispherical-shaped spark insert having a plurality of wall portions that are equally-spaced apart around its peripheral edge.

In a preferred embodiment of the present invention, there is provided a spark-based igniting system for internal combustion engines which includes a cylinder, at least one piston, a combustion chamber, a spark insert, and a RF energy source. The piston is disposed within the cylinder for moving slidably between a top dead center position and a bottom dead center position. The combustion chamber is formed in fluid communication with the piston. The spark insert is disposed in a top surface combustion face of the piston. The RF energy source is formed on the cylinder and adjacent to the combustion chamber for introducing spark ignition energies to the spark insert to cause igniting of air/fuel mixture within the combustion chamber when the piston reaches near the top dead center position.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
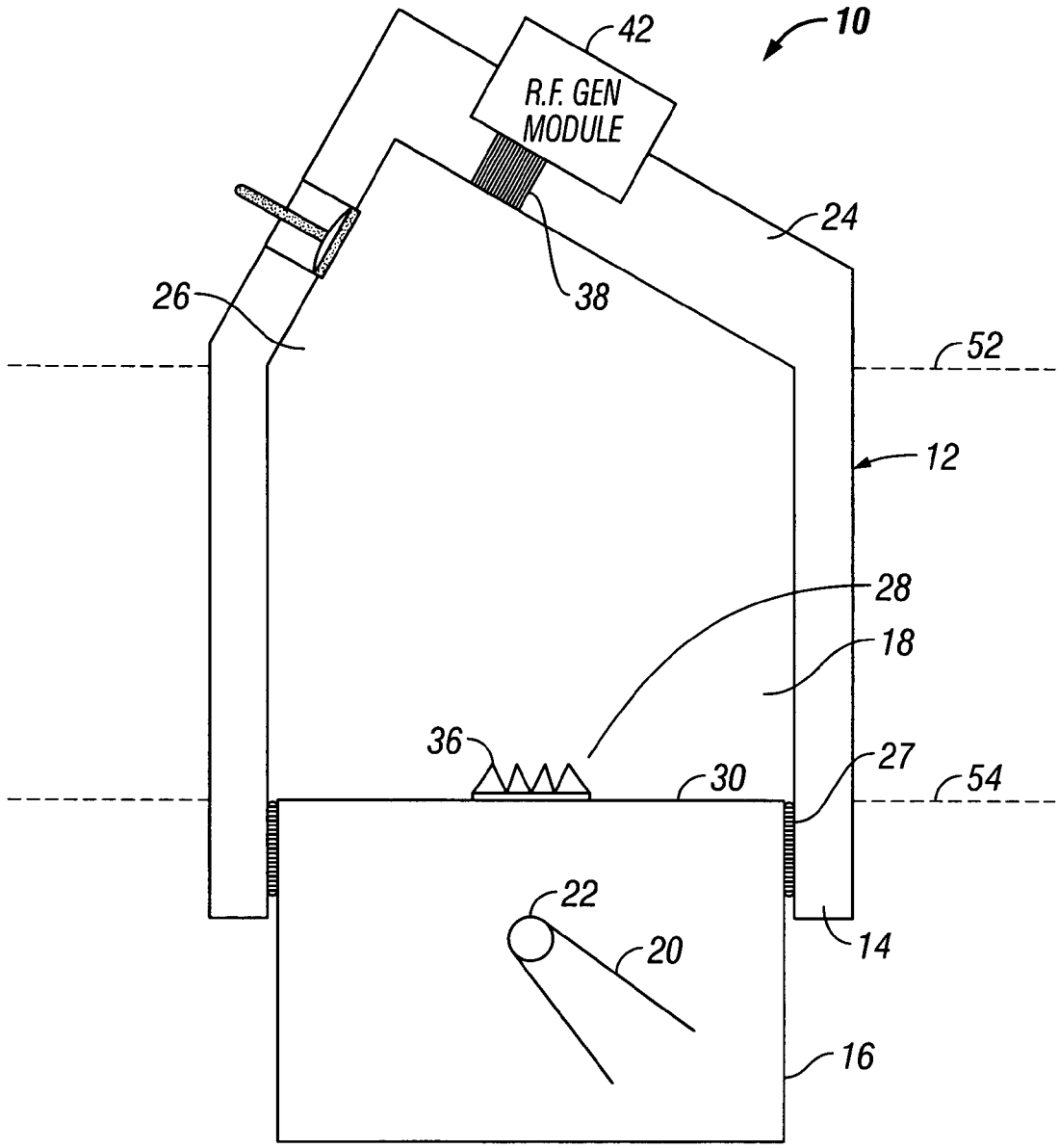
FIG. 1 is a cross-sectional view of a spark-based igniting system for an internal combustion engine during a compression stroke, constructed in accordance with the principles of the present invention.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

Figure 2:
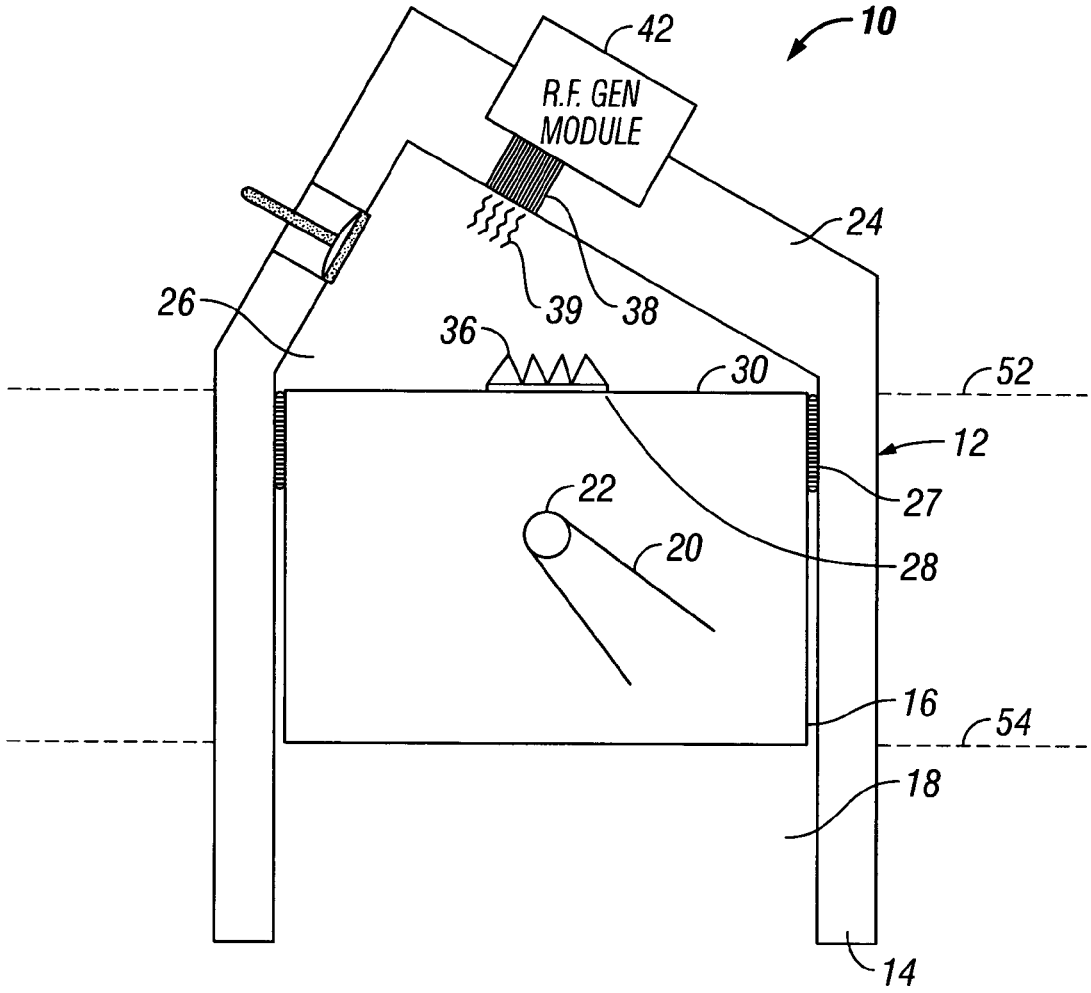
FIG. 2 is a cross-sectional view of the spark-based igniting system of FIG. 1 at near top dead center.

Referring now in detail to the drawings, there is illustrated in FIGS. 1 and 2 an improved spark-based igniting system 10 for an internal combustion engine 12, constructed in accordance with the principles of the present invention. FIG. 1 is a cross-sectional view of the spark-based igniting system for the internal combustion engine 12 during a compression stroke. FIG. 2 is cross-sectional view similar to FIG. 1, but with the piston at near top dead center.

The internal combustion engine 12 includes a block or cylinder assembly 14 having a plurality of pistons 16 (only one being depicted) slidably movable within a corresponding cylinder 18. A connecting rod 20 is used to operatively connect at its one end to the piston 16 via a pin mechanism 22 so that the piston can reciprocate within the cylinder 18 upon rotation of a conventional crankshaft (not shown). The crankshaft is geared directly or indirectly to a distributor shaft (also not shown) of a conventional ignition distributor. A cylinder head 24 serves to cover the cylinder assembly 14 and includes a plurality of combustion chambers 26 (one being shown) formed in fluid communication therewith. A set of piston rings 27 creates an airtight seal between the piston 16 and the cylinder 18.

Each of the combustion chambers 26 has an associated intake port, fuel inlet means, intake valve, exhaust valve, and exhaust port, which have all been omitted from FIGS. 1 and 2 so as not to unnecessarily obscure the present invention. It should be understood by those skilled in the art that such components are not required to fully appreciate the functioning of the present invention.

Figure 4:
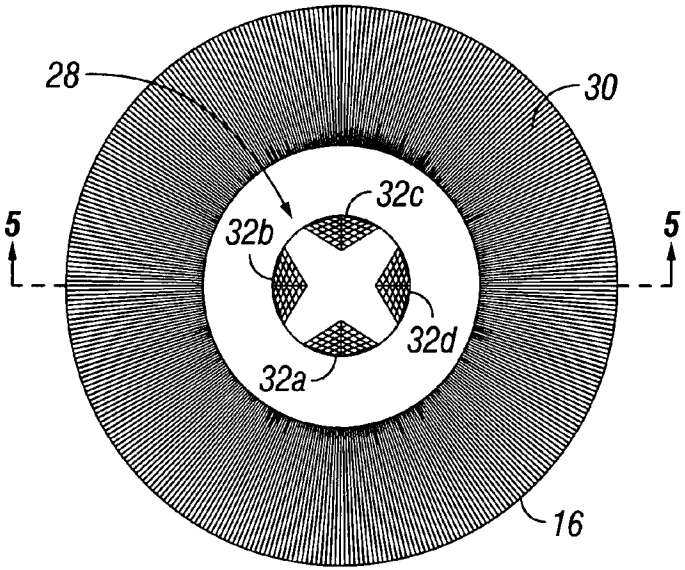
FIG. 4 is a top plan view of the piston, taken along the lines 4—4 of FIG. 3.
Figure 3:
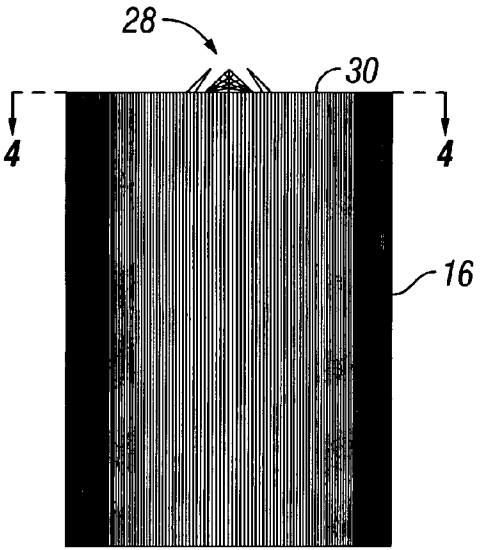
FIG. 3 is a side elevational view of the piston with the embedded spark insert.
Figure 5:
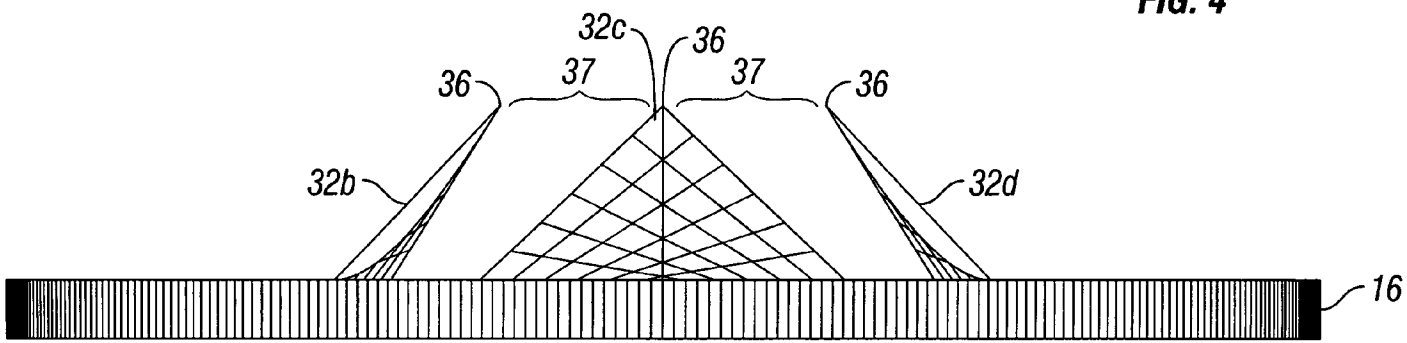
FIG. 5 is an enlarged, cross-sectional view of the embedded spark insert, taken along the lines 5—5 of FIG. 4.

As illustrated generally in FIGS. 1 and 2 and in detail in FIGS. 3 through 5, a set of sparking electrodes defined by a hemispherical-shaped spark insert 28 is embedded into the top surface combustion face 30 of the piston 16. The spark insert 28 includes a plurality (four) wall portions 32*a*–32*d* which are equally-spaced apart at 90 degrees around its peripheral edge 34. It can thus be seen that the wall portions 32*a* and 32*c* are positioned in a diametrically opposed relationship. Similarly, the wall portions 32*b* and 32*d* are positioned in a diametrically opposed relationship and are disposed between the respective wall portions 32*a* and 32*c*.

Each of the wall portions 32*a*–32*d* is of a generally triangular shape and terminates in a corresponding tip 36 forming the sparking electrodes. The resulting igniting sparks 37 will be produced from a corresponding tip 36 on one of the wall portions to the other remaining tips 36 on the other wall portions. The sparking electrodes or tips 36 define a plurality of sharpened points from which the ignition spark energies are manifested. Consequently, there will be generated a more uniform distribution of the sparking ignition force due to a greater utilization of the petroleum-derived fuel fed into the combustion chamber.

The set of sparking electrodes or tip 36 is powered or fed with igniting spark energy via a RF energy transparent portal 38 positioned adjacent to one side of the cylinder head 24. The igniting sparks using RF energy is coupled through the transparent portal 38 in the form of an electromagnetic wave 39 into the cylinder head 24 and is absorbed and acted upon by the set of sparking electrodes 36. A block diagram of a RF energy source network 40 and its associated components used for generating or inducing the igniting sparks to the spark insert 28 to cause igniting of the air/fuel mixture within the combustion chamber 26 is illustrated in FIG. 6.

Figure 6:
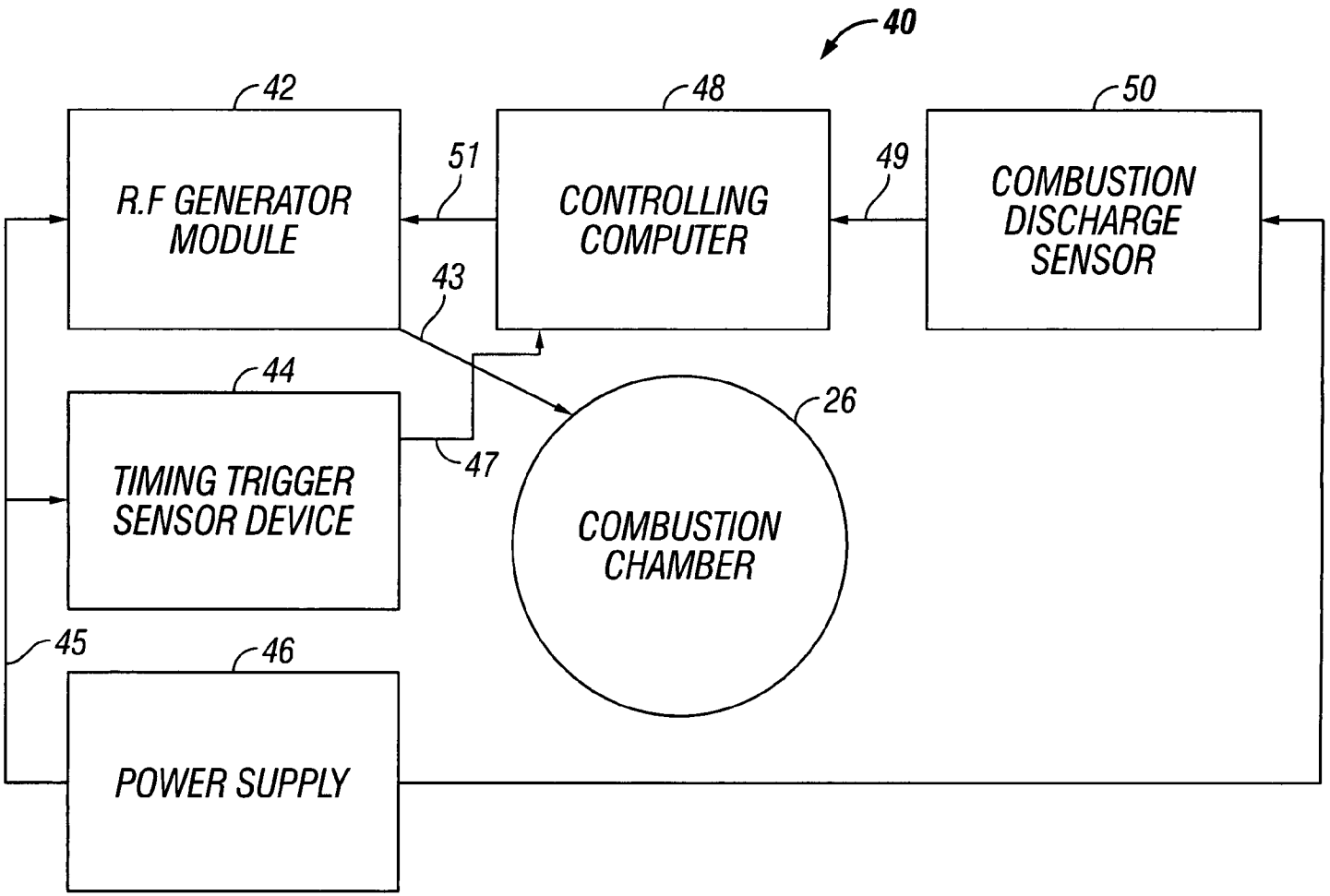
FIG. 6 is a block diagram of a RF energy source and its associated components used for generating spark ignition to the embedded spark insert.

With reference now to FIG. 6, the RF energy source network 40 is comprised of a RF generator module 42, a timing trigger sensor device 44, power supplies 46, a controlling computer 48, and a combustion discharge sensor 50. There is a RF generator module 42 associated with each corresponding cylinder 18. The RF generator module 42 is positioned on top or in close proximity to the cylinder head 24 so as to permit efficient coupling of the RF energy into the respective cylinder. This RF generator module is capable of supplying the energy necessary to initiate the igniting force required by the set of sparking electrodes 36.

The RF generator module 42 includes a RF energy producing device referred to commonly as a Magnetron which produces the igniting force supplied to the set of sparking electrodes 36 via line 43. The Magnetron is powered by a high voltage generated from the power supplies 46 via line 45. The RF module 42 also includes a trigger or electronic firing control for the Magnetron and a switching module for the RF energy generated by the Magnetron.

The timing trigger sensor device 44 is used to determine the top dead center (TDC) position of the pistons in the respective cylinders (i.e., cylinders 1–8 in a V-8 type engine) or the correct firing window in other types of internal combustion engines. The sensor device 44 preferably includes a magnetic probe for determining the position of the crankshaft along with a modified conventional "distribution" in order to define the next cylinder or firing chamber in line for "sparking" activity. An output signal from the sensor device 44, which is preferably magnetic in nature, is fed via line 47 to the controlling computer 48.

The combustion discharge sensor 50 is used to continuously detect or sense the condition of the combustion product, i.e., exhaust gases. The sensing may be preferably performed on a cylinder-by-cylinder basis, one at a time, or on the exhaust stream coming from the cylinder block as a combined average exhaust product. An output signal representative of combustion data from the sensor 50 is fed to the controlling computer via line 49.

The controlling computer is operated by a stored program and receives the cylinder location data from the output signal on the line 47 and the combustion data on the line 49. Based upon this information, the computer will generate an output signal on line 51 which is sent to the RF module 42 for controlling the firing window required to achieve the desired complete combustion of the air/fuel mixture in the combustion chamber and thus higher efficiency.

During combustion, the sensors also determine whether the combustion meets the required criteria for maximum horsepower and efficiency of combustion with minimized generation of pollutants. Numerous parameters are sampled and corrected during this time period. For example, these correction parameters would include, but not be limited to, igniting start time, igniting stop time, duration of igniting pulse, continuous igniting action and pulsed igniting action. Unlike the conventional spark plug systems, the igniting system of the present invention is capable of supplying an igniting arc in a sustained mode for a period of time grater than the power stroke of the cylinder. Further, a continuous igniting arc can be started, stopped, and re-started within a single combustion cycle if required, and such igniting spark can be sustained until the exhaust valve opens which encompasses a rotation value of greater than 180 degrees, thereby utilizing all of the air/fuel mixture in the cylinder and thus guaranteeing a complete combustion. Without this continuous ignition, the denotation within the cylinder, once ignited, can and often does burn or snuff itself out which wastes fuel and sacrifices horsepower while generating excess pollutants.

With reference again to FIGS. 1 and 2, the operation of the igniting system 10 for the internal combustion engine will now be described. The piston 16 reciprocates within the cylinder 18 during the operation of the combustion engine. An intake stroke (FIG. 2) is initiated when the piston head is located at the top dead center (TDC) position defined by the horizontal dotted line 52. In this condition, the intake valve is opened by any means well known in the art and the piston 16 will move slidably down inside of the cylinder 18 and away from the cylinder head 24.

Simultaneously, an air/fuel mixture will be drawn into combustion chamber 26 via the intake port. When the piston head reaches bottom dead center (BDC) position defined by the horizontal dotted line 54, the intake valve will close so as to begin the compression stroke. During the compression stroke (FIG. 1), the piston will travel toward the cylinder head 24 along the inside of the cylinder towards to the TDC position, the piston will be compressing the air/fuel mixture in the combustion chamber.

When the piston approaches near the end of the compression stroke, the RF module 42 will deliver an RF energy in the form of the electromagnetic waves 39 via line 43 into the combustion chamber 26. This will generate a corona effect high voltage discharge acted upon by a resonant effect of the physical geometry of the spark insert 28 in proximity to the R.F. energy transparent portal 38 of the combustion chamber 26 as it physically relates to the plurality of electrodes 36 which will ignite the air/fuel mixture in the combustion chamber. This electrical discharge will continue to operate and the air/fuel mixture will be continuously ignited as a power stroke is expended and will continue until all of the air/fuel mixture is burned, or the stroke is completed just prior to bottom dead center of the combustion stroke, thereby promoting higher efficiencies and minimizing the generation of pollutants.

This results in a more uniform complete combustion within the combustion chamber so as to produce higher efficiencies and lower pollutant levels. Consequently, there will be a significant increase in efficiency and developed horsepower. The expansive force of the ignited air/fuel mixture will force the piston to travel back down the cylinder towards the BDC position, defining the power stroke. This power stroke exerts torque on the crankshaft. When the piston reaches the BDC position again, the exhaust valve is opened and the exhaust gases are forced out of the cylinder through the exhaust port as the piston travels back towards the TDC position.

Figure 7:
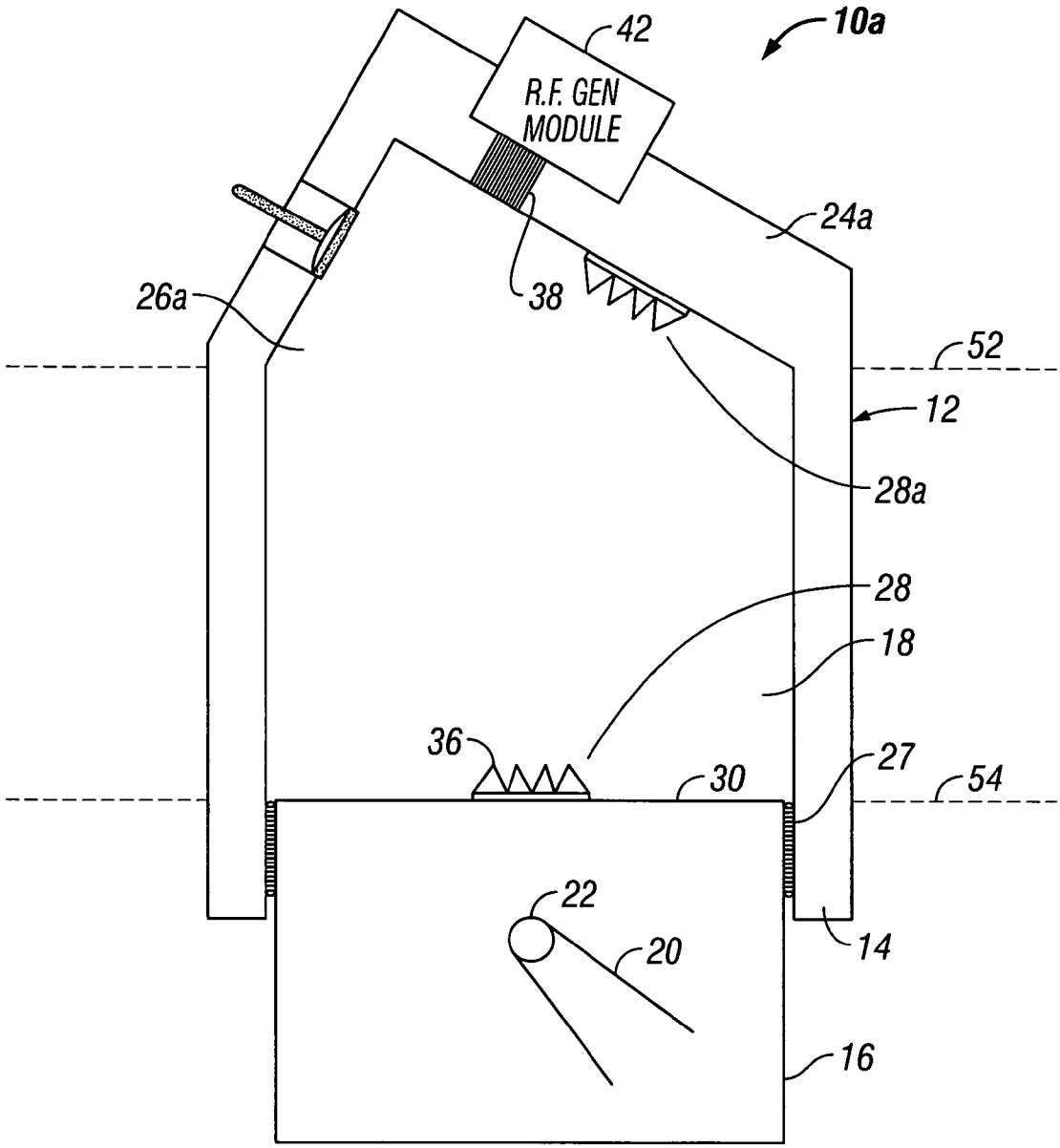
FIG. 7 is a cross-sectional view of a second embodiment of spark-based igniting system for an internal combustion engine according to the present invention.

FIG. 7 depicts a cross-sectional view of a second embodiment of a spark-based igniting system 10*a* for an internal combustion engine. The igniting system 10*a* of FIG. 7 is substantially identical to the igniting system 10 of FIGS. 1 and 2, except there is provided at least one additional spark insert 28*a* which is embedded in an internal surface of the cylinder head 24*a* and extends inwardly into the combustion chamber 26*a*. Furthermore, it should be clearly understood by those skilled in the art that any number of spark inserts 28*a* may be added as may be required for certain applications, such as racing applications where high compression ratios and high-octane fuel are utilized.

The igniting system 10*a* in this second embodiment will facilitate accelerated combustion of the high-octane fuel, thereby increasing horsepower and torque. Except for these differences, the construction and operation of the igniting system 10*a* is identical to the igniting system 10 of FIGS. 1 and 2. Therefore, a detailed description of its structural details and modes of operation will not be repeated again herein.

From the foregoing detailed description, it can thus be seen that the present invention provides a spark-based igniting system for an internal combustion engines which includes a spark insert embedded in a top surface combustion face of a piston and a RF energy source for generating spark ignition to the spark insert. As a result, the need of conventional spark plugs has been eliminated and the emission of pollutants into the atmosphere has been substantially reduced.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. A spark-based igniting system for internal combustion engines comprising:

cylinder means;

at least one piston being disposed within said cylinder means for moving slidably between a top dead center position and a bottom dead center position;

a combustion chamber being formed in fluid communication with said piston;

sparking electrodes means being disposed in a top surface combustion face of said piston;

said sparking electrodes means including a hemispherical-shaped spark insert having a plurality of wall portions which are arranged equally-spaced apart around its peripheral edge; and RF energy source means being formed on said cylinder means and adjacent to said combustion chamber for generating spark ignition energies to said sparking electrodes means to cause igniting of an air/fuel mixture within said combustion chamber when said piston reaches near the top dead center position.

2. A spark-based igniting system as claimed in claim 1, wherein said plurality of wall portions consist of at least two wall portions.

3. A spark-based igniting system as claimed in claim 1, further comprising at least one additional spark insert which is embedded in an internal surface of a cylinder head and is extended inwardly into the combustion chamber.

4. A spark-based igniting system as claimed in claim 1, wherein each of said plurality of wall portions is formed of a generally triangular shape and terminates in a corresponding tip defining a sparking electrode.

5. A spark-based igniting system as claimed in claim 4, wherein igniting sparks are produced from said tip on one of the wall portions to the remaining tips on the other wall portions, thereby generating a more uniform distribution of the spark ignition.

6. A spark-based igniting system as claimed in claim 1, wherein said RF energy source means is positioned adjacent to said combustion chamber for feeding the spark ignition energies into said combustion chamber via a R.F. energy transparent portal.

7. A spark-based igniting system for internal combustion engines in which a piston is disposed within a cylinder for moving slidably between a top dead center position and a bottom dead center position, said igniting system comprising:

a spark insert embedded in a top surface combustion face of said piston;

said spark insert being of a hemispherical shape and having a plurality of wall portions which are arranged equally-spaced apart around its peripheral edge; and a RF energy source being formed on said cylinder for generating spark ignition energies to said spark insert to cause igniting of air/fuel mixture in said cylinder when said piston reaches near the top dead center position.

8. A spark-based igniting system as claimed in claim 7, wherein said plurality of wall portions consist of at least two wall portions.

9. A spark-based igniting system as claimed in claim 7, further comprising at least one additional spark insert which is embedded in an internal surface of a cylinder head and is extended inwardly into the combustion chamber.

10. A spark-based igniting system as claimed in claim 7, wherein each of said plurality of wall portions is formed of a generally triangular shape and terminates in a corresponding tip defining a sparking electrode.

11. A spark-based igniting system as claimed in claim 10, wherein igniting sparks are produced from said tip on one of the wall portions to the remaining tips on the other wall portions, thereby generating a more uniform distribution of the spark ignition.

12. A spark-based igniting system as claimed in claim 7, wherein said RF energy source is formed of a RF generator module, a timing trigger sensor device, a controlling computer, and a combustion discharge chamber.

13. A spark-based igniting system as claimed in claim 12, wherein said computer controls said RF generator module to produce a firing timing window required for complete combustion of the air/fuel mixture in the combustion chamber in response to data received from said trigger sensor device and said combustion discharge sensor.

14. A method for a spark-based igniting system for internal combustion engines comprising:

providing cylinder means;

moving slidably at least one piston within the cylinder means between a top dead center position and a bottom dead center position;

providing a combustion chamber in fluid communication with the piston;

embedding sparking electrodes means in a top surface combustion face of the piston;

said sparking electrodes means including a hemispherical-shaped spark insert having a plurality of wall portions which are arranged equally-spaced apart around its peripheral edge; and generating spark ignition to the sparking electrodes means through an RF energy source formed on the cylinder means and adjacent to the combustion chamber to cause igniting of air/fuel mixture within the combustion chamber when the piston reaches near the top dead center position.

15. A method for a spark-based igniting system as claimed in claim 14, further embedding at least one additional spark insert in an internal surface of a cylinder head which is extended inwardly into the combustion chamber.

16. A spark-based igniting system for internal combustion engines comprising:

cylinder means;

at least one piston being disposed within said cylinder means for moving slidably between a top dead center position and a bottom dead center position;

a combustion chamber being formed in fluid communication with said piston;

sparking electrodes means being disposed in a top surface combustion face of said piston;

RF energy source means being formed on said cylinder means and adjacent to said combustion chamber for generating spark ignition energies to said sparking electrodes means to cause igniting of an air/fuel mixture within said combustion chamber when said piston reaches near the top dead center position; and said RF energy source means including a RF energy source network formed of a RF generator module, a timing trigger sensor device, a controlling computer, and a combustion discharge sensor.

17. A spark-based igniting system as claimed in claim 16, wherein said computer controls said RF generator module to produce a firing timing window required for complete combustion of the air/fuel mixture in the combustion chamber in response to data received from said trigger sensor device and said combustion discharge sensor.

* * * * *